US008860571B2

(12) United States Patent
Mahajan

(10) Patent No.: US 8,860,571 B2
(45) Date of Patent: Oct. 14, 2014

(54) EMERGENCY RESPONDER ACCOUNTABILITY ALARM

(71) Applicant: Cellco Partnership, Arlington, VA (US)

(72) Inventor: Amit Mahajan, Bridgewater, NJ (US)

(73) Assignee: Cellco Partnership, Basking Ridge, NJ (US)

( * ) Notice: Subject to any disclaimer, the term of this patent is extended or adjusted under 35 U.S.C. 154(b) by 1 day.

(21) Appl. No.: 13/718,272

(22) Filed: Dec. 18, 2012

(65) Prior Publication Data

US 2014/0167955 A1 Jun. 19, 2014

(51) Int. Cl.
*G08B 1/08* (2006.01)
*G08B 21/02* (2006.01)

(52) U.S. Cl.
CPC ..... *G08B 21/02* (2013.01)
USPC ..... 340/539.12; 340/539.23; 340/572.1; 455/404.1

(58) Field of Classification Search
CPC .. G08B 25/10; G08B 2001/085; G08B 21/02; H04M 11/04
USPC ..... 340/539.1–539.13, 539.15, 539.23; 455/404.1, 404.2
See application file for complete search history.

(56) References Cited

U.S. PATENT DOCUMENTS

| | | | | |
|---|---|---|---|---|
| 6,812,840 | B2 * | 11/2004 | Gehlot et al. | 340/572.1 |
| 7,091,852 | B2 * | 8/2006 | Mason et al. | 340/539.13 |
| 7,538,666 | B2 * | 5/2009 | Campman | 340/539.13 |
| 7,907,052 | B2 * | 3/2011 | Delaney, Jr. | 340/539.11 |
| 8,305,196 | B2 * | 11/2012 | Kennedy et al. | 340/10.4 |
| 8,410,925 | B2 * | 4/2013 | Hess | 340/539.11 |
| 8,599,010 | B2 * | 12/2013 | Bose et al. | 340/539.13 |
| 2002/0008625 | A1 * | 1/2002 | Adams et al. | 340/573.1 |
| 2010/0081411 | A1 * | 4/2010 | Montenero | 455/404.2 |
| 2010/0227585 | A1 * | 9/2010 | Carroll et al. | 455/404.2 |
| 2011/0140913 | A1 * | 6/2011 | Montenero | 340/870.07 |
| 2013/0082837 | A1 * | 4/2013 | Cosentino et al. | 340/539.12 |
| 2013/0093589 | A1 * | 4/2013 | Hsiao | 340/539.13 |

* cited by examiner

*Primary Examiner* — Eric M Blount

(57) ABSTRACT

A system includes a slave device associated with a unique identifier and a master device in communication with the slave device. In response to receiving from the slave device a status signal indicating an emergency event associated with the slave device, the master device is configured to determine a status of the slave device, receive, from a personnel database, personnel information associated with the personnel identifier, generate an alarm signal containing the personnel information, and transmit the alarm signal with the personnel information to a medical facility computing system. The alarm signal is based at least in part on the status of the slave device. The slave device includes a processor configured to access the personnel identifier from a memory device, generate a status signal that includes the personnel identifier, and transmit the status signal to the master device.

23 Claims, 6 Drawing Sheets

EMERGENCY RESPONDER ACCOUNTABILITY ALARM

BACKGROUND

Currently, to monitor the location of firefighters or other emergency responders an accountability system is used that requires each firefighter to carry a number of colored tags, such as a yellow tag and a red tag. The firefighter may leave the yellow tag at a central collection point upon arriving at an event zone and retrieve his or her yellow tag when leaving the event zone. An accountability officer can use the yellow tags at the collection point to determine which firefighters are in the event zone at any particular time. The red tag may be left at the entrance of a structure in the event zone and retrieved when the firefighter leaves the structure. The accountability officer can determine who is in the structure based on the red tags left behind.

DETAILED DESCRIPTION

Accountability tag systems give an accountability officer useful information about the emergency responders in an event zone. The nature of those tag systems—leaving and collecting tags at various locations throughout the event zone—could result in inaccurate information and cannot quickly identify certain issues. An exemplary emergency responder system that addresses these issues is described herein. The exemplary emergency responder accountability system includes a slave device associated with a personnel identifier and a master device in communication with the slave device. The slave device may be carried by an emergency responder into an event zone, such as the location of a fire or other location where emergency responders are needed. The master device may be used by an accountability officer, such as a fire chief, to monitor the location and status of each emergency responder in the event zone. The master device is configured to determine a status of the slave device, receive, from a personnel database, personnel information associated with the personnel identifier, generate an alarm signal, and transmit the alarm signal with the personnel information to a medical facility computing system based at least in part on the status of the slave device. The slave device includes a processor configured to access the personnel identifier from a memory device, generate the status signal that includes the personnel identifier, and transmit the status signal to the master device. With this exemplary emergency responder accountability system, the accountability officer can continuously monitor each emergency responder in the event zone. Moreover, should one of the emergency responders become injured or require rescue, the accountability system can notify the appropriate medical facility, which may retrieve appropriate medical records, dispatch an emergency vehicle to the event zone, and coordinate with other medical facilities.

Figure 1:
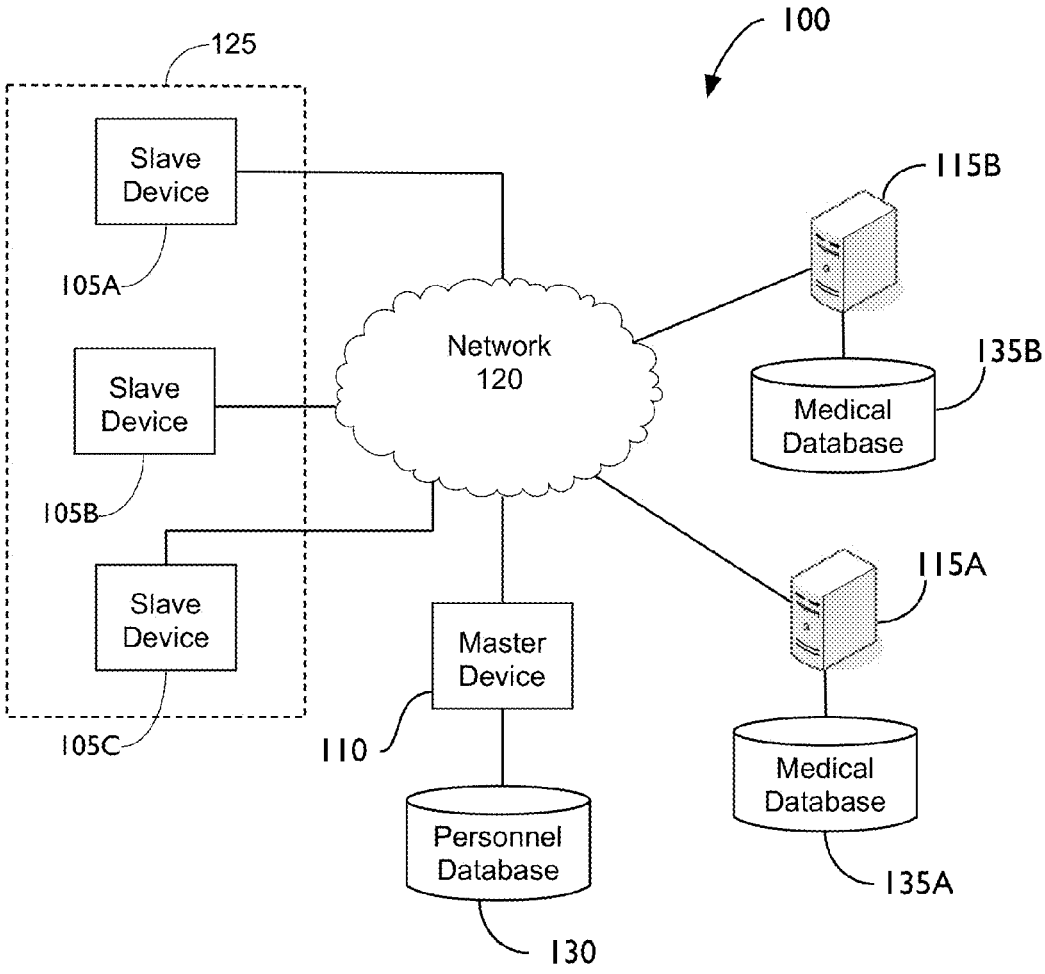
FIG. 1 illustrates an exemplary emergency responder accountability system for communicating personnel information to a medical facility computing system.

FIG. 1 illustrates an exemplary emergency responder accountability system. The system may take many different forms and include multiple and/or alternate components and facilities. While an exemplary system is shown, the exemplary components illustrated in the figures are not intended to be limiting. Indeed, additional or alternative components and/or implementations may be used. The exemplary emergency responder accountability system 100 of FIG. 1 includes multiple slave devices 105A-C (collectively, 105), a master device 110, and medical facility computing systems 115A-B (collectively, 115). Communication among the slave devices 105, master device 110, and the medical facility computing systems 115 may be via a communication network 120.

The slave device 105 may accompany an emergency responder into an event zone 125 during an emergency. The event zone 125 may include any area where emergency responders are needed. The event zone 125 may include the location of a fire, for instance. While three slave devices 105 are shown in the event zone 125 of FIG. 1, the event zone 125 may include any number of slave devices 105, such as at least one slave device 105 per emergency responder. The slave device 105 may be manufactured to withstand exposure to different environments such as exposure to water, fire, or both. The slave device 105 may have a relatively small profile so that it may be, e.g., embedded into the emergency responder's uniform or otherwise carried by an emergency responder. In one possible approach, the slave device 105 may always be within reach of the emergency responder while in the event zone 125.

The slave device 105 may be configured to receive and generate different types of signals. One type of signal generated by the slave device 105 may include a status signal that indicates that an emergency responder is in danger and requires rescue. The status signal may be automatically generated under various circumstances. For example, the status signal may be automatically generated if the emergency responder stops moving for a minimum amount of time. The amount of time may depend upon the emergency responder and the event zone. It may be rare for a firefighter to stop moving for, e.g., 5 seconds while inside a burning building but may be still for longer periods of time when, e.g., deciding which direction to go. A police officer may go even longer without moving. For instance, a police officer may remain relatively still when confronting a criminal. Another instance where the status signal may be automatically generated is in response to a sudden or unexpected acceleration, which may occur from a vehicle collision or a floor collapse. Moreover, the emergency responder may be able to manually generate the status signal by pressing, e.g., a panic button on the slave device 105 to trigger a "mayday" call. In one possible implementation, the status signal may indicate that the victim is someone other than the emergency responder. For instance, the emergency responder may trigger the slave device 105 to send the status signal on behalf of a victim found in the event zone 125, as discussed below. The status signal may include a unique identifier, such as a personnel identifier or a device ID that identifies the emergency responder carrying the slave device 105. The personnel identifier may include the emergency responder's name or identification number. Additionally, the personnel identifier may include organizational affiliation (e.g., fire station number, police department precinct, emergency medical services (EMS) employer, etc.), and basic medical information such as date of birth, blood type, brief medical history, known allergies, and the like. Other types of signals that may be generated by the slave device 105 are discussed below with respect to FIG. 3 and may include, e.g., a sensor signal and a location signal.

The slave device 105 may be configured to receive various signals, such as an activate signal from, e.g., the master device 110. For instance, the slave device 105 may include a wake-up circuit or implement a technology such as Zigbee® that allows the slave device 105 to enter into a low power (i.e., "sleep") state while occasionally listening for the activate signal from the master device 110. Upon receipt of the activate signal, the slave device 105 may become activated, which means that the activate signal may wake the slave device 105 from the "sleep" state or cause the slave device 105 to power on. The slave device 105 may be configured to only transmit the status signal after the activate signal has been received. Generation and transmission of the activate signal by the master device 110 is described in greater detail below. Each slave device 105 may be configured to send the status signal to only one master device 110, and in particular, to the master device 110 that sent the activate signal. The slave device 105 may be further configured to receive a deactivate signal, which may cause the slave device 105 to enter a "sleep" state or cause the slave device 105 to power down until activated again. Other types of signals received by the slave device 105 may include signals related to the geographic location of the slave device 105 from, e.g., a Global Positioning System (GPS), as discussed in greater detail below. The slave device 105 may become enabled or awake from the "sleep" state in response to a user input. For example, the emergency responder carrying the slave device 105 can turn on the slave device 105 by pressing a button or providing another input to the slave device 105 (e.g., shaking the slave device 105).

The slave device 105 may be configured to warn the emergency responder that the status signal will be transmitted to allow the emergency responder an opportunity to override transmission of the status signal to the master device 110. In one possible approach, the warning may include an audible alarm that gradually increases in volume, pitch, tempo, etc., until reaching a steady state. The warning may further or alternatively include a visual alarm that may include one or more lights that blink at an increasing frequency until reaching a steady state. The slave device 105 may transmit the status signal once the audible or visual alarm reaches the steady state. The emergency responder may have a predetermined amount of time to override transmission of the status signal. For instance, the slave device 105 may give the emergency responder, e.g., five seconds to disable the status signal. The warning may begin as soon as the slave device 105 determines that the emergency responder may be in distress. The amount of time before the warning begins may depend on context, as discussed above. The emergency responder may override transmission of the status signal by providing an input to the slave device 105 such as by pressing a button or shaking the slave device 105.

The master device 110 may include any device configured to communicate with the slave device 105 over the communication network 120. The communication network 120 may include a network extender (not shown) accessible to both the slave device 105 and the master device 110. Alternatively or in addition, a network extender may be embedded into the slave device 105, the master device 110, or both. The master device 110 may be carried by an accountability officer in the event zone 125 to monitor the status of each of the save devices. The accountability officer may use the master device 110 to determine whether any emergency responders in the event zone 125 are in danger, and if so, transmit the emergency responder's medical information to the most capable medical facility in case medical treatment is needed. The master device 110 may be configured to identify the most capable medical facility from factors such as proximity to the event zone 125, injury sustained by the emergency responder, or the like. For instance, if an emergency responder is burned while in the event zone 125, the most capable medical facility may be the closest medical facility with a burn unit. The master device 110 may identify the most capable medical facility from information stored on the master device 110 or accessible over the network 120. For example, the master device 110 may use a map to identify the closest medical facility and use information about the closest medical facility available over the network 120 or stored locally on the master device 110 to determine whether the closest medical facility can treat the rescued emergency responder. The master device 110 may be further configured to store or access information about other local medical facilities to help determine if another medical facility is more capable to treat the rescued emergency responder. In one possible approach, the master device 110 may be embodied in a tablet or other type of handheld or mobile computing device.

The master device 110 may be configured to receive signals, such as the status signal, from the slave device 105. The master device 110 may be configured to recognize, from the status signal of a particular slave device 105, that the emergency responder carrying that slave device 105 is in danger and requires rescue. In one possible approach, receipt of the status signal may indicate that the emergency responder is in danger. Alternatively, the master device 110 may be configured to determine whether the emergency responder is in danger based on information transmitted with the status signal. For instance, the status signal may indicate that a victim found in the event zone 125 is in danger. The master device 110 may be configured to present an indication of the danger to the accountability officer so that the emergency responder in danger may be rescued. In addition, the master device 110 may be configured to generate and transmit over a wireless network an alarm signal based at least in part on the status of the slave device 105 if the master device 110 determines that the emergency responder needs to be rescued or requires medical attention.

For example, the status signal generated by the slave device 105 may represent various circumstances where the master device 110 should generate the alarm signal. If the status signal indicates that the emergency responder has not moved in the last five seconds, the master device 110 may determine that the emergency responder is in danger and generate the alarm signal. The status signal may further include information about the ambient air temperature near the slave device 105, whether the slave device 105 is submerged in water, the amount of oxygen in the air near the slave device 105, whether the emergency responder has moved recently, and a physiological parameter of the emergency responder. The information transmitted in the status signal may be obtained through one or more sensors located on the slave device 105, as discussed in greater detail below. The master device 110 may be configured to generate the alarm signal based on any one of these or other circumstances indicated by the status signal. The indication presented and/or alarm signal generated may differ based on the circumstance indicated by the information in the status signal, by the particular geographical location (e.g., building) within the event zone from which the status signal originates, the number of status signals received and/or specific emergency responder corresponding to the status signal. For example, master devices 110 for police, emergency medical technicians (EMTs), and firefighters may generate different alarms, as may a captain, lieutenant, and non-officer of the fire department or members of the same type of emergency responder but from different stations/precincts.

To generate the alarm signal, the master device 110 may be configured to access and query one or more databases, such as the personnel database 130, over the communication network 120. Alternatively, the personnel database 130 may be stored directly on the master device 110. The personnel database 130 may associate a unique identifier, such as the personnel identifier or device ID transmitted by the slave device 105, with personnel information that may include the name, date of birth, organizational affiliation (e.g., fire station number, police department precinct, EMS employer, etc.), and basic medical information of the emergency responder. The basic medical information stored in the personnel database 130 may include any one or more of the following: date of birth, blood type, brief medical history, known allergies, and the like. The master device 110 may be configured to query the personnel database 130 to retrieve personnel information associated with the personnel identifier, generate the alarm signal to include the retrieved personnel information, and transmit the alarm signal with the personnel information to the closest medical facility computing system 115. In some cases, the personnel information retrieved or sent to the medical facility computing system 115 may be limited to less than that available in the personnel database 130 based on the type of emergency generating the alarm signal. For instance, the personnel information may be limited to information related to treatment of the rescued emergency responder and may exclude other types of information. Examples of excluded information may include number of years working as an emergency responder, the emergency responder's rank within the organization, salary or income information, etc. The master device 110 may determine which personnel information is appropriate under the circumstances. Alternatively, the master device 110 may be configured to retrieve and transmit particular personnel information with the alarm signal. If the victim is not an emergency responder, little if any information may be known about the victim at the time of rescue. When the victim is not the emergency responder, the master device 110 may transmit the personnel information indicating that the victim is unknown (e.g., "John Doe" or "Jane Doe").

The master device 110 may be configured to generate the alarm signal independent of receiving the status signal, such as in response to a user input received from the accountability officer viewing information presented on the master device 110. In one possible approach, the master device 110 may be configured to present a map of the event zone 125, and the position of each slave device 105 may be overlaid onto the map. The position of each slave device 105 may be determined from, e.g., the status signal or another type of signal received from each slave device 105. Using the information presented by the master device 110 or other information, the accountability officer may determine that one or more emergency responders are in danger. The master device 110 may be configured to receive a user input from the accountability officer that causes the master device 110 to generate the alarm signal and transmit the alarm signal to the medical facility computing system 115. The user input may identify the slave device 105 of the emergency responder in danger, as discussed below with reference to FIG. 4, and the master device 110 may access the personnel information associated with the identified slave device from the personnel database 130.

The master device 110 may be configured to wait a predetermined amount of time before transmitting the alarm signal to the medical facility computing system 115. In one possible approach, the master device 110 may present an indication to the user that an emergency responder is in danger and wait for the user to confirm that the alarm signal should be transmitted. Alternatively, the master device 110 may be configured to generate and transmit the alarm signal unless the master device 110 receives a user input cancelling the alarm signal. For example, the master device 110 may wait a predetermined amount of time after generating the alarm signal before the alarm signal is transmitted to the medical facility computing system 115 to allow the user time to override or cancel an alarm signal. During the predetermined amount of time, the master device 110 may be configured to receive a user input that cancels the alarm signal, meaning the alarm signal will not be transmitted to the medical facility computing system 115. The master device 110 may also allow the user to cancel the alarm signal even after the predetermined amount of time has elapsed and the alarm signal has been transmitted to the medical facility computing system 115. For instance, the master device 110 may be configured to generate and transmit a cancel signal to the medical facility computing system 115 in response to a user input. The cancel signal may instruct the medical facility computing system 115 to ignore the alarm signal.

The master device 110 may be configured to select, either automatically or manually, a particular medical facility computing system 115 as the intended recipient of the alarm signal. The master device 110 may select the medical facility computing system 115 associated with the medical facility that is closest to the event zone 125 as the intended recipient. Alternatively, the master device 110 may select the medical facility computing system 115 associated with the medical facility most capable to treat the rescued emergency responder as the intended recipient. That is, if the rescued emergency responder was burned while in the event zone 125, the master device 110 may select the medical facility computing system 115 for the closest medical facility able to treat burns as the intended recipient of the alarm signal. The master device 110 may select the medical facility based, at least in part, on the personnel information. To do so, the master device 110 may be configured to access the personnel information using the personnel identifier or other type of unique identifier received from the slave device 105 prior to selecting the medical facility. Accordingly, other factors that may be considered by the master device 110 include the rescued emergency responder's previous medical history, the location of the rescued emergency responder's primary care physician, the event type (e.g., burn, gunshot wound, etc.), the quality of the medical facility, the extent of injuries sustained by the rescued emergency responder, a user preference received from the accountability officer or the rescued emergency responder, etc. When selecting the medical facility, the master device 110 may be configured to weight some or all of the factors described above, and the weight may change based on circumstances. For example, the master device 110 may, in some instances, assign the greatest weight to the rescued emergency responder's preference for medical facility. If the rescued emergency responder's injuries are life threatening, the master device 110 may assign the greatest weight to the closest medical facility available to treat the emergency responder.

The master device 110 may be configured to allow the accountability officer to define the event zone 125 and to assign different slave devices 105 to the event zone 125. The slave devices 105 assigned to the event zone 125 may be in accordance with the emergency responders at the event zone 125 providing emergency assistance. For example, if the event zone 125 includes a fire at a building, the slave devices 105 assigned to the event zone 125 may include the slave devices 105 of the firefighters who are at the building to fight the fire. The master device 110 may be configured to present a list of possible slave devices 105 to assign to the event zone 125 to the accountability officer. The accountability officer may assign slave devices 105 to the event zone 125 by user inputs provided to the master device 110 such as a selection of one or more buttons associated with the slave devices 105 and the event zone 125. If the master device 110 includes a touch-sensitive display, different gestures may be used to assign one or more slave devices 105 to the event zone 125. An example gesture may include "dragging" the slave device 105 to a part of the touch-sensitive display representing the event zone 125.

The master device 110 may be configured to generate and transmit an activate signal to each slave device 105 assigned to the event zone 125 to activate one or more of the slave devices 105. In one possible approach, the slave device 105 may only send the status signal to the master device 110 that sent the activate signal. In addition or alternatively, each master device 110 may be configured to only "listen" for status signals for the slave devices 105 activated by the master device 110 or assigned to the event zone 125 by the master device 110. Therefore, if the slave device 105 is assigned to an event zone 125 by a different master device 110, the master device 110 may ignore status signals transmitted from the slave device 105. The activate signal may be generated and transmitted automatically in response to the master device 110 assigning the slave device 105 to the event zone 125. Alternatively, the activate signal may be generated and transmitted in response to a user input received from, e.g., the accountability officer.

The medical facility computing system 115 may include hardware such as one or more servers. The medical facility computing system 115 may be associated with a medical facility and may be configured to receive the personnel information from the master device 110. Two medical facilities are represented in FIG. 1 (a first medical facility and a second medical facility), and each may include its own medical facility computing system 115, illustrated as systems 115A and 115B, respectively. The system 100 may include any number of medical facilities with any number of medical facility computing systems 115.

The medical facility computing system 115 may be configured to query a medical database 135 for medical records associated with one or more patients of the medical facility. The medical database 135 may associate a patient's name with additional information about the patient, such as the patient's date of birth and a detailed medical history. The medical history stored in the medical database 135 may include the name of the patient's primary care physician, a summary of each visit to the medical facility, insurance information, known allergies, blood type, previous surgeries and procedures, lab results, etc. While only one medical database 135 is shown in FIG. 1, the system 100 may include any number of medical databases 135. Moreover, the first and second medical facility computing systems 115A and 115B may be configured to access different medical database 135. Indeed, the second medical facility computing system 115B may be unable to access the medical database 135 and may require that medical records stored in the medical database 135 be transmitted from the first medical facility computing system 115A.

The medical facility computing system 115 may be configured to query the medical database 135 for medical information for the patient identified by the personnel information in the alarm signal received from the master device 110. The medical facility computing system 115 may be configured to recognize that receipt of the alarm signal from the master device 110 means that the emergency responder identified by the personnel information required rescue while responding to an emergency in an event zone 125. The medical facility computing system 115 may be configured to notify one or more departments, such as the emergency department or surgery, in the medical facility in response to receiving the alarm signal from the master device 110. The notification sent to the emergency department may include some or all of the personnel information transmitted to the medical facility computing system 115. In some instances, the notification may describe the type of injury sustained by the rescued emergency responder, which may be based on a user input at the master device 110. The notification may be addressed to the medical facility computing system 115, which may forward the notification to the appropriate department based on, e.g., the type of injury. For instance, a burn unit at the medical facility may be notified if the injury was the result of a burn and the emergency department or surgery may be notified if the injury includes a gunshot wound or other specific trauma. If the type of injury is unknown or for other types of trauma, the emergency department may receive the notification by default.

The medical facility computing system 115 may dispatch an ambulance, helicopter, or other emergency vehicle to the event zone 125 in response to receiving the alarm signal. In one possible approach, the master device 110 may transmit the location of the slave device 105 of the injured emergency responder to the medical facility computing system 115. The medical facility computing system 115 may generate a notification that includes the location to the emergency vehicle service along with the personnel information. The location may include GPS coordinates, latitude and longitude coordinates, a street address, or any other information that may be used to find the injured emergency responder. When the emergency vehicle arrives, the emergency medical technicians (EMTs) in the emergency vehicle may have had an opportunity to review the injured emergency responder's medical history and can develop a plan to treat the type of trauma suffered by the injured emergency responder while travelling to the event zone 125.

Sometimes, the rescued emergency responder is not a patient of the medical facility that receives the alarm signal. In this instance, the medical facility computing system 115 that receives the alarm signal may be configured in response to receiving the alarm signal to determine that the rescued emergency responder is not a patient and seek out the emergency responder's medical records from another medical facility. The medical facility with the emergency responder's medical records may be determined from the personnel information stored in the personnel database 130 and transmitted with the alarm signal. The medical facility computing server 115 that receives the alarm signal may be configured to identify which medical database 135 has the medical records for the rescued emergency responder. The medical facility may also or alternatively be configured to search for the medical records if the other medical facility cannot be determined. If the medical database 135 of the first medical facility computing system 115A does not contain medical records for the rescued emergency responder, the first medical facility computing system 115A may be configured to query the second medical facility computing system 115B for the appropriate medical records.

In response to such a query, the second medical facility computing system 115B may be configured to query its own medical database 135B using, e.g., personnel information received from the first medical facility computing system 115A. If the rescued emergency responder is a patient of the second medical facility, the second medical facility computing system 115B may transmit the rescued emergency responder's medical records to the first medical facility computing system 115A for treatment at the first medical facility. The medical records transmitted may be limited to those relevant to the type of injury sustained by the rescued emergency responder. Alternatively, the transmitted medical records may contain the rescued emergency responder's complete medical history or a subset of the rescued emergency responder's medical history. If the rescued emergency responder is not a patient of the second medical facility either, the first medical facility computing system 115A, the second medical computing system, or both, may query other medical facility computing systems 115 to find the appropriate medical records for the rescued emergency responder. Once found, the medical records may be transmitted back to the first medical facility computing system 115A.

In some instances, the first medical facility computing system 115A, selected by the master device 110, may not be able to treat the injured emergency responder. The first medical facility computing system 115A may communicate with the second medical facility computing system 115B to either arrange for the injured emergency responder to be transported (i.e., via ambulance or helicopter) to the second medical facility for treatment or to have staff or resources from the second medical facility brought to the first medical facility to treat the injured emergency responder. Therefore, the first medical facility computing system 115A may be configured to determine that the first medical facility is not fully equipped to treat the injured emergency responder and seek out resources of the second medical facility that may be used to treat the injured emergency responder. For instance, the first medical facility computing system 115A may be configured to identify physicians of the second medical facility with the skills or qualifications to treat the injured emergency responder. The notification sent to the second medical facility computing system 115B may request that the identified physician come to the first medical facility to help treat the injured emergency responder or request that the second medical facility make preparations to receive the injured emergency responder for treatment.

Figure 2:
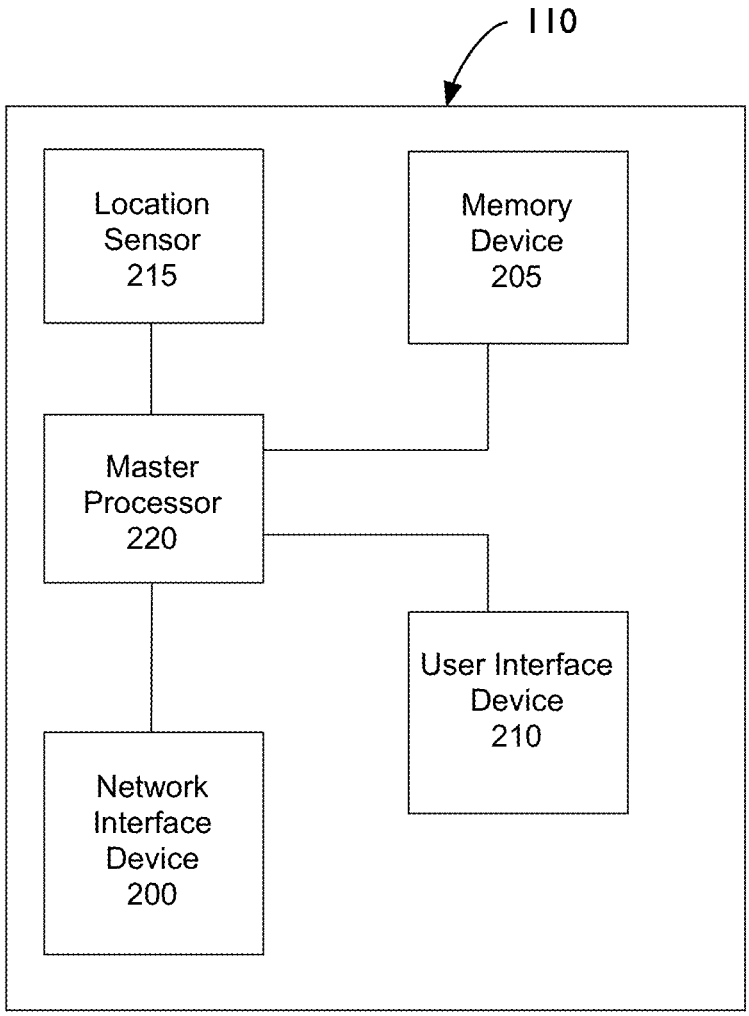
FIG. 2 is a block diagram illustrating exemplary components of the master device of FIG. 1.

FIG. 2 is a block diagram illustrating exemplary components of the master device 110. The exemplary master device 110 of FIG. 2 includes a network interface device 200, a memory device 205, a user interface device 210, a location sensor 215, and a master processor 220.

The network interface device 200 may include any hardware that allows the master device 110 to receive and transmit signals over a network, such as the communication network 120. The network interface device 200 may include an antenna for wireless communication and may be configured to generate signals in accordance with one or more communication protocols such as those for communicating over a packet-switched network or a cellular telecommunication network 120. The network interface device 200 may be configured to receive messages from the slave device 105 and transmit messages to the slave device 105 and the medical facility computing system 115.

The memory device 205 may include any volatile or non-volatile memory configured to electronically store information or computer-executable instructions. The memory device 205 may store the personnel identifier received from one or more slave devices 105 in communication with the master device 110. The memory device 205 may further store information related to the assignment of slave devices 105 to the event zone 125, maps of the event zone 125, and the location of each slave device 105. Example instructions stored in the memory device 205 may include instructions for querying the personnel database 130 based on the personnel information received from the slave device 105 or in response to a user input. Other example instructions stored in the memory device 205 may include instructions for generating the alarm signal and transmitting the alarm signal to a particular medical facility computing system 115.

The user interface device 210 may include any hardware that can be used to present information to a user, receive inputs from a user, or both. In one possible approach, the user interface device 210 includes a touch-sensitive display that can present information to a user via, e.g., a graphical user interface and receive user inputs through, e.g., a virtual keyboard or virtual buttons and objects such as icons. The user interface device 210 may be configured to convert the user inputs received into signals representing the user's intent for interacting with the master device 110. For example, the user interface device 210 may be configured to identify certain "gestures" performed by the user as the user input. An example "gesture" may include the user dragging an icon representing a slave device 105 to a part of the display screen representing the defined event zone 125. Another example "gesture" may include the user selecting one or more slave devices 105 and instructing the master device 110 to generate the alarm signal with the personnel information for the selected slave devices 105.

The user interface device 210 may be configured to present various types of information to the user of the master device 110. For instance, the user interface device 210 may present a map of the event zone 125 that shows the location of each slave device 105 overlaid on the map. The location of each slave device 105 may be determined from the location signal generated by each slave device 105, as discussed in greater detail below. The map may be stored in the memory device 205 or accessed over the communication network 120.

The location sensor 215 may include any device configured to help determine a relative location of the master device 110. The location sensor 215 may be configured to communicate with a positioning system such as the Global Positioning System (GPS). The location sensor 215 may be configured to generate a location signal representing the relative location of the master device 110 based on, e.g., the communication with GPS satellites.

The master processor 220 may include any computer processing device in communication with the network interface device 200, the memory device 205, the user interface device 210, and the location sensor 215. The master processor 220 may be configured to access the memory device 205 and execute the instructions stored in the memory device 205. Moreover, the master processor 220 may be configured to receive and interpret the signals received by the network interface device 200 or from the user interface device 210. For example, the master processor 220 may be configured to determine a status of the slave device 105 from the status signal received from the slave device 105 and determine whether to generate the alarm signal based at least in part on the status signal. The master processor 220 may be further configured to determine the status of the slave device 105 based on whether the slave device 105 has become unresponsive or is not operating properly since a failure to receive the location signal from the slave device 105 may indicate that the slave device 105 is not operating properly, which may suggest that the emergency responder is in danger. As a result of a failed communication attempt with the slave device 105, the master processor 220 may note the last location of the slave device 105 and generate the alarm signal. Moreover, the master processor 220 may cause the user interface device 210 to present an indication to the accountability officer that communication with the slave device 105 was lost. The master processor 220 may present the indication that the slave device 105 is lost if, e.g., the slave device fails to respond to a ping or other keepalive signal from the master processor 220. Alternatively or in addition, the master processor 220 may be configured to determine that the slave device 105 is lost if the master processor 220 fails to receive a heartbeat signal from the slave device 105. The master processor 220 may also receive a battery level of the slave device 105 and may use the last known battery level to determine whether the ping response, keepalive response, or heartbeat signal failed because of a low battery level or because the emergency responder carrying the slave device 105 is in danger. If communication with the slave device 105 is lost for a reason other than a low battery level, the master processor 220 may be configured to automatically present the indication that communication has been lost, along with the reason, if known. The indication may be presented on a map showing the last known location of the slave device 105. In some instances, the master processor 220 may automatically generate and transmit the alarm signal once communication with the slave device 105 is lost. Instead of or in addition to relying on the status of the slave device 105, the master processor 220 may be configured to determine whether to generate the alarm signal based on the user input received via the user interface device 210. That is, the master processor 220 may be configured to receive a signal, from the user interface device 210, representing a user's desire to transmit the alarm signal with the personnel identifier associated with a particular slave device 105.

To generate the alarm signal, the master processor 220 may query the personnel database 130 for personnel information associated with the personnel identifier received from the slave device 105 or stored in the memory device 205. The alarm signal may be generated to include the personnel information retrieved. The master processor 220 may select a medical facility computing system 115 as the intended recipient of the alarm signal based on the closest medical facility able to treat the rescued emergency responder, address the alarm signal to the selected medical facility computing system 115, and transmit the alarm signal to the selected medical facility computing system 115 using, e.g., the network interface device 200.

The master processor 220 may be further configured to assign one or more slave devices 105 to the event zone 125. The master processor 220 may be configured to define the event zone 125 based on, e.g., a user input received via the user interface device 210. Defining the event zone 125 may include receiving signals from the user interface device 210 representing user inputs made through the virtual keyboard or through a user selection of a map or map boundaries. The master processor 220 may be configured to name the event zone 125 in accordance with signals received from the user interface device 210 and provided to the user interface device 210 by the user via the virtual keyboard.

Once the event zone 125 has been defined, the master processor 220 may be configured to assign different slave devices 105 to the event zone 125 based on user inputs. The master processor 220 may cause the user interface device 210 to display a list of possible slave devices 105 and may receive signals from the user interface device 210 indicating which slave devices 105 the user selected to associate with the event zone 125. The master processor 220 may associate the selected slave devices 105 to the event zone 125 by, e.g., storing a table linking the selected slave devices 105 to the event zone 125 in the memory device 205. After the event, the master processor 220 may be configured to delete the table from the memory device 205 or otherwise disassociate the selected slave devices 105 from the event zone 125.

The master processor 220 may be configured to generate the activate signal after at least one slave device 105 is assigned to the event zone 125. The master processor 220 may designate the selected slave devices 105 (i.e., the slave devices 105 assigned to the event zone 125) as the intended recipients of the activate signal and transmit the activate signal to the selected slave devices 105 via the network interface device 200. The master processor 220 may generate and transmit the activate signal in response to one or more slave devices 105 being assigned to the event zone 125 or in response to a user input received via the user interface device 210.

Figure 3:
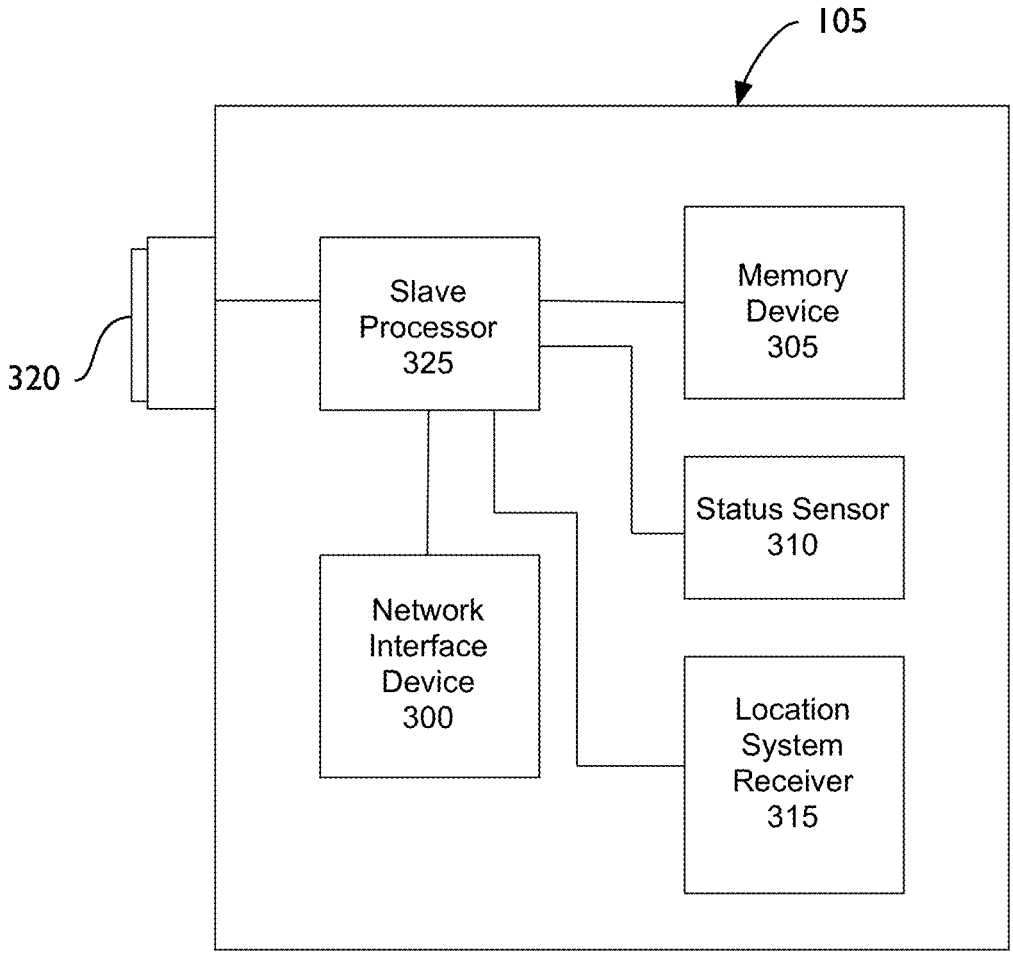
FIG. 3 is a block diagram illustrating exemplary components of the slave devices of FIG. 1.

FIG. 3 is a block diagram illustrating exemplary components of the slave devices 105 of FIG. 1. As illustrated, the slave device 105 includes a network interface device 300, a memory device 305, a status sensor 310, a location system receiver 315, a user input device 320, and a slave processor 325.

The network interface device 300 may include any hardware that allows the slave device 105 to receive and transmit signals over a network, such as the communication network 120. The network interface device 300 may include an antenna for wireless communication and may be configured to generate signals in accordance with one or more communication protocols such as those for communicating over a packet-switched network or a cellular telecommunication network 120. The network interface device 300 may be configured to receive messages from and transmit messages to the master device 110. In one exemplary approach, the network interface device 300 may be configured to transmit a response to a ping or keepalive signal received from the master device 110. Moreover or in the alternative, the network interface device 300 may be configured to transmit a heartbeat signal to the master device 110. A battery level of the slave device 105 may be transmitted to the master device 110 via the network interface device 300 so the master device 110 can determine whether a low battery level played contributed to a failed ping response, keepalive response, or heartbeat signal.

The memory device 305 may include any volatile or non-volatile memory configured to electronically store information or computer-executable instructions. The memory device 305 may store the personnel identifier associated with the slave device 105. Example instructions stored in the memory device 305 may include instructions for generating the status signal and for transmitting the status signal to the master device 110.

The status sensor 310 may include any number of sensing devices configured to determine a status of the slave device 105 or the emergency responder and generate an appropriate sensor signal. The status of the slave device 105 may be based on whether the emergency responder carrying the slave device 105 is in danger. The status sensor 310 may include a motion sensor, such as an accelerometer, configured to measure whether the emergency responder carrying the slave device 105 has not moved within a minimum amount of time. Since it is unlikely that certain emergency responders would purposely stay still for a moment during an emergency, the status sensor 310 may be configured to output a sensor signal indicating that the emergency responder stopped moving after a minimum amount of time, which may depend upon the circumstances, with no movement has elapsed. The motion sensor may further detect sudden or unexpected acceleration, which may occur from a vehicle collision or floor collapse. The status sensor 310 may include a temperature sensor configured to measure an ambient air temperature in the immediate vicinity of the slave device 105. If the ambient air temperature exceeds a predetermined minimum temperature, the status sensor 310 may include the measured temperature in the sensor signal. A moisture sensor may be used by the status sensor 310 to determine whether the slave device 105 has become submerged in water. If so, the sensor signal may indicate that a water rescue may be necessary. The status sensor 310 may include an oxygen sensor to measure an amount of oxygen in the air near the slave device 105. If the amount of oxygen drops below a minimum level, the sensor signal may indicate that the oxygen level is dangerously low. Another possible sensor included in the status sensor 310 may include a physiological sensor configured to monitor the emergency responder's heart rate, blood oxygen level, or another physiological parameter. The sensor signal, therefore, may represent the measured physiological parameter.

The location system receiver 315 may include any device configured to help determine a relative location of the slave device 105. The location system receiver 315 may be configured to communicate with a positioning system such as the Global Positioning System (GPS). The location system receiver 315 may be configured to generate a location signal representing the relative location of the slave device 105 based on, e.g., the communication with GPS satellites.

The user input device 320 may include any device configured to receive an input from the user indicating the user's desire for the slave device 105 to transmit the status signal to the master device 110. The user input device 320 may include a "panic button" that the user may press when he or she is in danger. The user input device 320 may be configured to transmit a signal indicating the user's desire to transmit the status signal to the master device 110. The signal may further indicate whether the victim is someone other than the emergency responder. For example, the emergency responder may provide an input to the user input device 320 that indicates that a victim requires rescue. One possible input to the user input device 320 may include pressing the "panic button" twice in succession within a predetermined amount of time (e.g., 1 second). Alternatively, a different user input device (not shown) may be included on the slave device for victims other than the emergency responder.

The slave processor 325 may include any computer processing device configured to receive the signals generated by any one or more of the network interface device 300, the memory device 305, the status sensor 310, the location system receiver 315, and the user input device 320. The slave processor 325 may be configured to access the information and computer-executable instructions stored in the memory device 305. For example, the slave processor 325 may be configured to access the personnel identifier from the memory device 305, generate the status signal that includes the personnel identifier, and transmit the status signal to a master device 110 via the network interface device 300 based on instructions stored in the memory device 305.

The slave processor 325 may be configured to generate and transmit the status signal to the master device 110 in response to the sensor signal or in response to the user pressing the user input device 320 (i.e., the "panic button"). Each status signal may include the personnel identifier stored in the memory device 305, any information received at the slave processor 325 from the status sensor 310, the location information received from the location system receiver 315, or the like. Moreover, the status signal may indicate whether the status signal was generated and transmitted as a result of the user pressing the "panic button," on behalf of the emergency responder or on behalf of another victim, or as a result of information contained in the sensor signal. For instance, the slave processor 325 may generate the status signal to indicate whether the sensor signal indicates that the user has not moved for a minimum amount of time, that the emergency responder's heart stopped beating or blood oxygen level has dropped to a critically low value, that the slave device 105 has become submerged in water, or that the amount of oxygen is critically low. The slave processor 325 may be configured to transmit the status signal only when the emergency responder is in danger. The location signal may be transmitted periodically (i.e., every few seconds) to the master device 110 via the network interface device 300, however.

The slave processor 325 may be configured to activate the slave device 105 in response to receiving the activate signal from the master device 110. Prior to receiving the activate signal, the slave device 105 may be in a "sleep" state. The slave processor 325 may receive the activate signal from the master device 110 via the network interface device 300, and in response, enable the slave device 105. That is, the slave processor 325 may cause the slave device 105 to change from a "sleep" state to an "awake" state. The slave processor 325 may be configured to only generate the status signal while in the "awake" state. Further, the slave processor 325 may be configured to only send the status signal to the master device 110 that transmitted the activate signal.

Figure 4:
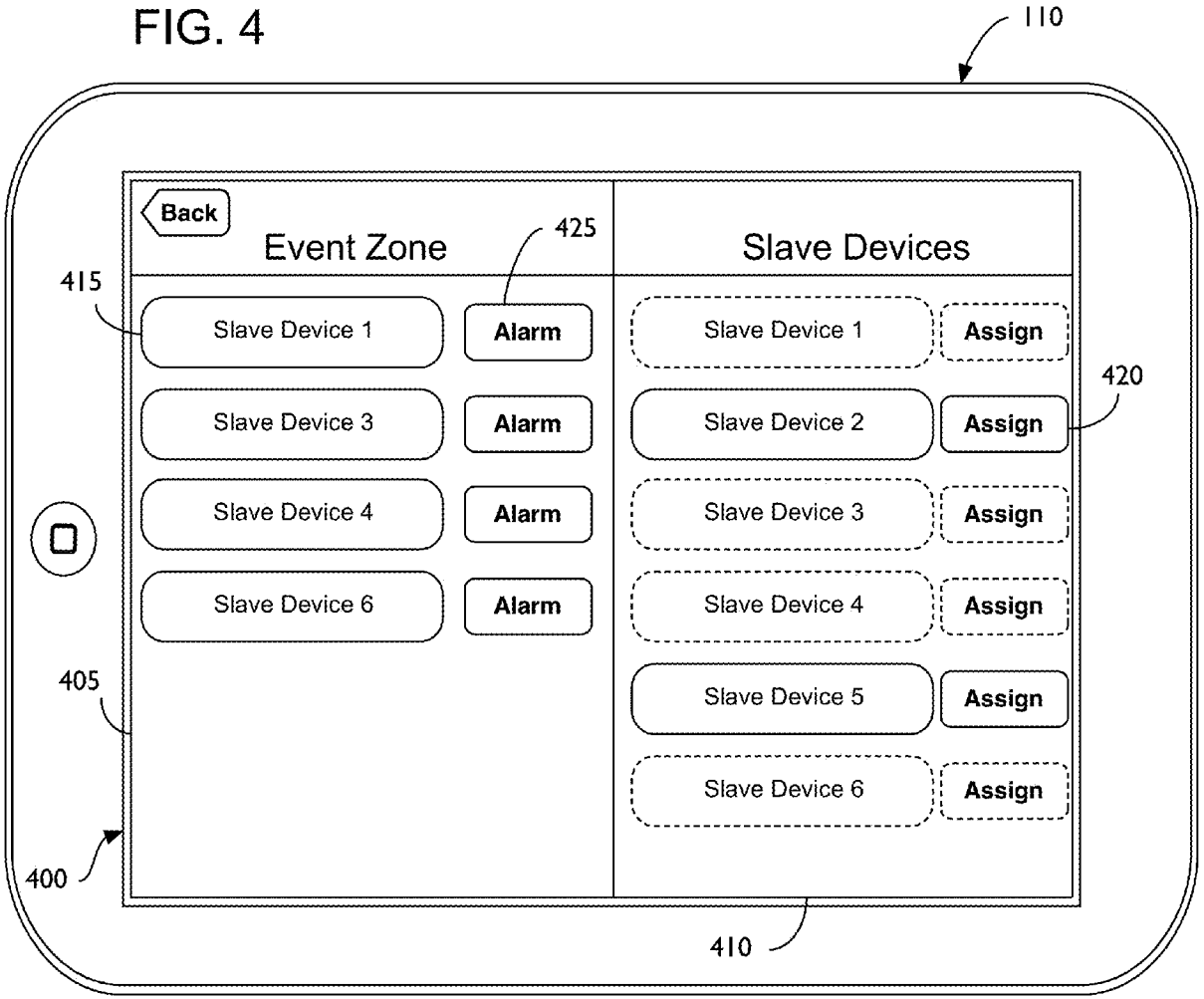
FIG. 4 illustrates an exemplary user interface display of the master device.

FIG. 4 illustrates an exemplary user interface display 400 of the master device 110. The exemplary user interface display 400 includes a first pane 405 that identifies an event zone 125 and the slave devices 105 already assigned to the event zone 125. The second pane 410 includes a list of possible slave devices 105 that may be assigned to the event zone 125. Some of the slave devices 105 are shown in dashed line to indicate that they have already been assigned to the event zone 125. The slave devices 105 may be represented by a name, number, or personnel identifier, for example. As illustrated, each slave device 105 is represented by an icon 415 with the device name and a number (i.e., "Slave device 1," "Slave device 2," and so on). One way to assign the slave device 105 to the event zone 125 may include a "drag" gesture; that is, the accountability officer dragging the representation of a slave device 105 from the second pane 410 to the first pane 405. Another way to assign the slave device 105 to the event zone 125 may require the user to select a virtual "assign" button 420. The exemplary user interface display 400 may further include a virtual "alarm" button 425 for each slave device 105 assigned to the event zone 125. The user of the master device 110 may press the "alarm" button 425 to generate the alarm signal for that slave device 105 and transmit the alarm signal to the medical facility computing system 115 for, e.g., the nearest medical facility.

Figure 5:
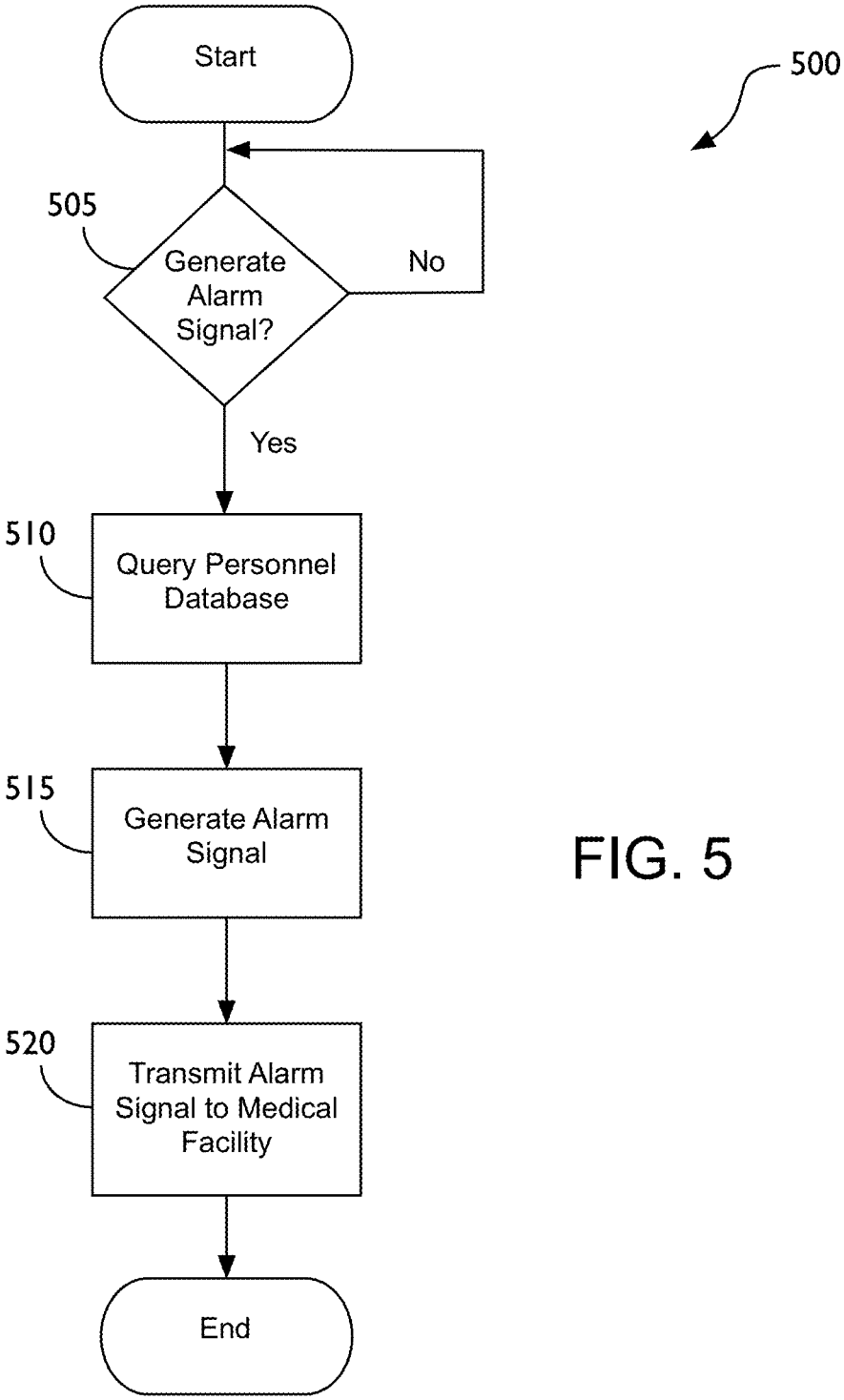
FIG. 5 is a flowchart of an exemplary process that may be implemented by the master device for generating and transmitting an alarm signal to the medical facility computing system.

FIG. 5 is a flowchart of an exemplary process 500 that may be implemented by the master device 110. In one possible implementation, the master processor 220 may execute the exemplary process 500 illustrated in FIG. 5.

At decision block 505, the master processor 220 may determine whether to generate the alarm. The master processor 220 may decide to generate the alarm based on any number of circumstances such as based on the status signal received from the slave device 105 or in response to a user input provided to the slave device 105 (e.g., via the "panic button") or the master device 110 (e.g., via the virtual "alarm" button 425). Moreover, the master processor 220 may decide to generate the alarm signal if communication with the slave device 105 is lost as a result of circumstances other than a power (e.g., battery level) failure. If the master processor 220 determines that the alarm signal should not be generated, the process 500 may repeat block 505 until the master processor 220 decides to generate the alarm. If the master processor 220 decides to generate the alarm signal, the process 500 may continue at block 510.

At block 510, the master processor 220 may query the personnel database 130 for the personnel information associated with the personnel identifier. The personnel identifier may be included in the status signal received from the slave device 105. Alternatively or in addition, the personnel identifier may be stored in the memory device 205 of the master device 110, which may be helpful if the master device 110 loses communication with the slave device 105. If the slave device 105 was activated on behalf of a victim other than an emergency responder, the personnel information retrieved from the personnel database 130 or otherwise included in the personnel information may reflect that the victim is presently unknown (e.g., "John Doe" or "Jane Doe"). After the personnel information has been retrieved, the process 500 may continue at block 515.

At block 515, the master processor 220 may generate the alarm signal. The alarm signal may include the personnel information identified at block 510. The master processor 220 may identify the closest medical facility able to provide medical services to the rescued emergency responder based on information stored in the memory device 205 of the master device 110 or retrieved over the communication network 120. The master processor 220 may further generate the alarm signal to include some information about the emergency responder in danger and the type of danger presented. For instance, the alarm signal may indicate whether the rescued emergency responder was injured, and if so, the extent of the injuries. Once the alarm signal is generated, the process 500 may continue at block 520.

At block 520, the master processor 220 may transmit the alarm signal to the medical facility computing system 115 of the medical facility best equipped to treat the rescued emergency responder. The medical facility computing system 115 may use the information accompanying the alarm signal to dispatch an ambulance or other emergency vehicle service to the event zone 125 and to notify, e.g., the emergency department, surgery department, burn unit, or another department that a rescued emergency responder is being transported to the medical facility for treatment. The medical facility computing system 115 may collect medical records for the rescued emergency responder from the medical facility's own or another medical facility's medical database. The process 500 may end after block 520.

Figure 6:
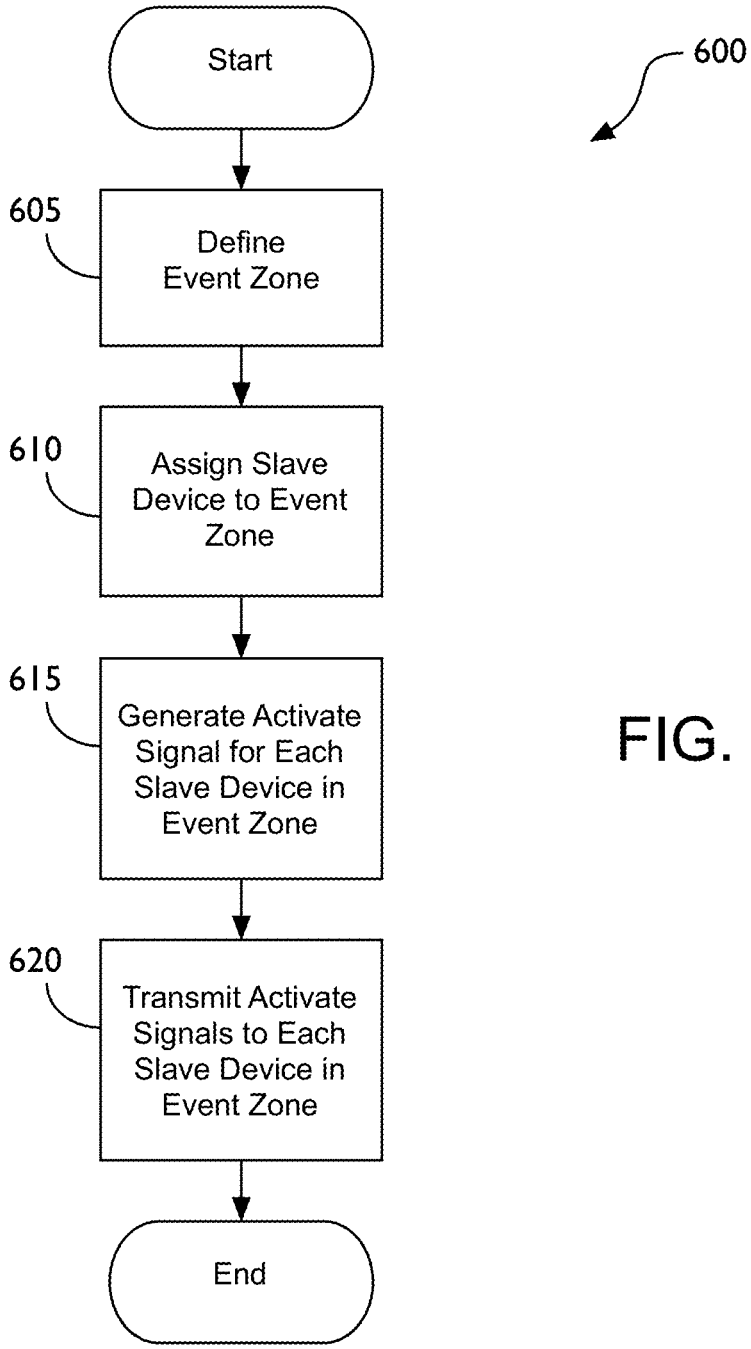
FIG. 6 is a flowchart of an exemplary process that may be implemented by the master device for assigning one or more slave devices to an event zone.

FIG. 6 is a flowchart of an exemplary process 600 that may be implemented by the master device 110 for assigning one or more slave devices 105 to an event zone 125.

At block 605, the master processor 220 may define the event zone 125. The master processor 220 may be configured to define the event zone 125 based on, e.g., a user input received via the user interface device 210. Defining the event zone 125 may include receiving signals from the user interface device 210 representing user inputs made through the virtual keyboard or through a user selection of a map or map boundaries.

At block 610, the master processor 220 may assign one or more slave devices 105 to the event zone 125. The master processor 220 may assign slave devices 105 to the event zone 125 in response to a user input, such as a "dragging" gesture or a user selection. Once slave devices 105 have been selected for the event zone 125, the master processor 220 may store a table linking the selected slave devices 105 to the event zone 125 in the memory device 205.

At block 615, the master processor 220 may generate an activate signal for each slave device 105 assigned to the event zone 125. The master processor 220 may designate the assigned slave device 105 as the intended recipient of the activate signal. The master processor 220 may automatically generate the activate signal after the slave device 105 is assigned to the event zone 125. Alternatively, the activate signal may be manually generated in response to a user input received via the user interface device 210 of the master device 110.

At block 620, the master processor 220 may transmit the activate signal to the slave device 105 or slave devices 105 assigned to the event zone 125. The master processor 220 may transmit the activate signal via the network interface device 200. The master processor 220 may automatically transmit the activate signal after the slave device 105 is assigned to the event zone 125. Alternatively, the activate signal may be manually transmitted in response to a user input received via the user interface device 210 of the master device 110. In some instances, the master processor 220 may determine whether the slave device 105 was previously turned on by, e.g., the emergency responder, and only transmit the activate signal if the slave device 105 is off or in a "sleep" state. The process 600 may end after block 620.

The exemplary emergency responder accountability system 100 discussed above allows an accountability officer, such as a fire chief, to continuously monitor each emergency responder in an event zone 125. Moreover, should one of the emergency responders become injured or require rescue, the accountability system 100 can notify the appropriate medical facility. In some exemplary approaches, multiple master devices 110 may be in use at the event zone 125. For example, each fire department station that responds to a fire at the event zone 125 may use a different master device 110 to monitor their own personnel. Where the tracking of multiple groups of emergency responders is necessary, a single master device 110 may be used to monitor the personnel from differing groups of emergency responders.

In general, computing systems and/or devices, such as the slave device, the master device, the medical facility computing system, and the components thereof, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., the BlackBerry OS distributed by Research In Motion of Waterloo, Canada, and the Android operating system developed by the Open Handset Alliance. Examples of computing devices include, without limitation, a computer workstation, a server, a desktop, notebook, laptop, or handheld computer, or some other computing system and/or device.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

The invention claimed is:

1. A system comprising:

a slave device associated with a unique identifier; and a master device in communication with the slave device and, in response to receiving from the slave device a status signal indicating an emergency event associated with the slave device, configured to:

determine a status of the slave device based on the status signal, receive, from a personnel database, personnel information associated with the unique identifier, generate an alarm signal containing the personnel information, and transmit the alarm signal to a medical facility computing system, the alarm signal based at least in part on the status of the slave device, the medical facility computing system configured to select a medical facility based on the alarm signal.

2. The system of claim 1, wherein the medical facility computing system is configured to select the medical facility based on an injury type indicated by the alarm signal, the alarm signal based at least in part on receiving a user input at the master device.

3. The system of claim 1, wherein the medical facility computing system is configured to query a medical database for patient information based at least in part on the personnel information received from the master device.

4. The system of claim 1, wherein the medical facility computing system includes a first medical facility computing system configured to transmit the patient information to a second medical facility computing system.

5. The system of claim 1, wherein the master device and personnel database are in communication over a network, and wherein the master device is configured to query the personnel database for the personnel information.

6. A non-transitory computer-readable medium tangibly embodying computer-executable instructions that cause a processor, when implementing the instructions, to perform actions comprising:

defining an event zone comprising a geographic boundary;

assigning a slave device to the event zone, the slave device associated with a unique identifier;

transmitting an activate signal to the slave device after assigning the slave device to the event zone;

determining a status of the slave device;

receiving, from a personnel database, personnel information associated with the unique identifier, generating an alarm signal containing the personnel information; and transmitting an alarm signal to a medical facility computing system, the alarm signal based at least in part on the status of the slave device, the medical facility computing system configured to select a medical facility based on the alarm signal.

7. The non-transitory computer-readable medium of claim 6, the instructions causing the processor, when implementing the instructions, to perform actions further comprising:

receiving a user input; and determining whether to generate the alarm signal based at least in part on the user input.

8. A master device comprising:

a network interface device in communication with a slave device associated with a unique identifier;

a processor in communication with the network interface device and configured to:

determine a status of the slave device, receive, from a personnel database, personnel information associated with the unique identifier, generate an alarm signal containing the personnel information, select a medical facility based on an injury type indicated by the alarm signal, and transmit the alarm signal with the personnel information to the medical facility computing system via the network interface device, wherein the alarm signal is based at least in part on the status of the slave device.

9. The master device of claim 8, wherein the processor is configured to determine whether to generate the alarm signal.

10. The master device of claim 9, wherein the processor is configured to determine whether to generate the alarm signal in response to a user input.

11. The master device of claim 8, wherein the processor is configured to:

define an event zone;

assign the slave device to the event zone; and transmit an activate signal to the slave device to enable the slave device in response to assigning the slave device to the event zone.

12. A slave device comprising:

a network interface device;

a memory device configured to store a unique identifier;

a user input device configured to receive a user input, the user input device switchable between an emergency responder mode wherein the slave device monitors an emergency responder and a non-responder victim mode wherein the slave device monitors a non-responder victim; and a processor in communication with the network interface device, the memory device, and the user input device, wherein the processor is configured to:

access the unique identifier from the memory device, generate a status signal that includes the unique identifier, and transmit the status signal to a master device via the network interface device in response to the user input.

13. The slave device of claim 12, wherein the processor is configured to transmit the status signal to the master device in response to a status request received from the master device.

14. The slave device of claim 12, further comprising a sensor configured to generate a sensor signal, wherein the processor is in communication with the sensor and configured to transmit the status signal to the master device based at least in part on the sensor signal.

15. The slave device of claim 12, wherein the user input device includes a panic button.

16. The slave device of claim 12, wherein the network interface device is configured to receive an activate signal from the master device, and wherein the processor is configured to generate the status signal only after receiving the activate signal from the master device.

17. The slave device of claim 12, further comprising a location system receiver configured to determine a relative geographic location within an event zone, wherein the processor is configured to transmit the relative geographic location to the master device.

18. The system of claim 1, wherein the medical facility computing system is configured to select the medical facility based on an injury type indicated by the alarm signal.

19. The system of claim 1, wherein the medical facility computing system is configured to select the medical facility based on personnel preferences contained within said personnel information.

20. The non-transitory computer-readable medium of claim 6, wherein the medical facility is selected based on an injury type indicated by the alarm signal.

21. The system of claim 1, wherein the alarm signal is automatically generated in response to a type of operator of the slave device provided by the personnel information and sensing a specific condition related to at least one of motion, sudden acceleration, temperature, air quality, and water after having determined that an abnormality exists between the operator type and sensed specific condition.

22. The system of claim 1, wherein the slave device is configured to:

generate a warning signal prior to indicating transmitting the status signal; and after generating the warning signal, provide an operator of the slave device an opportunity to override transmission of the status signal.

23. The system of claim 1, wherein the status signal indicates whether an operator of the slave device or an unknown victim is subject to the emergency event, and, in response to determine that the unknown victim is subject to the emergency event, the master device transmits personnel information indicating the victim is unknown.

* * * * *